US007882792B2

(12) United States Patent
de Mattos

(10) Patent No.: US 7,882,792 B2
(45) Date of Patent: Feb. 8, 2011

(54) AUXILIARY FLOATING STRUCTURE AND PROCEDURE FOR DESCENT OF EQUIPMENT INTO THE SEA

(75) Inventor: Jose Mauricio Ferreira de Mattos, Rio de Janeiro (BR)

(73) Assignees: Inspectronics Engenharia e Consultoria LTDA, Rio de Janeiro (BR); Zytech-Pesquisa, Desenvolvimento e Tecnologia Industrial Ltda, Rio de Janeiro (BR)

( * ) Notice: Subject to any disclaimer, the term of this patent is extended or adjusted under 35 U.S.C. 154(b) by 0 days.

(21) Appl. No.: 12/151,132

(22) Filed: May 1, 2008

(65) Prior Publication Data

US 2009/0194013 A1 Aug. 6, 2009

(30) Foreign Application Priority Data

Feb. 1, 2008 (BR) ..... 0800075

(51) Int. Cl.
*B63B 21/66* (2006.01)

(52) U.S. Cl. ..... 114/244; 114/264; 405/203

(58) Field of Classification Search ..... 114/248, 114/264, 267, 244; 405/195.1, 203, 204, 405/205, 206, 209, 210, 224, 226
See application file for complete search history.

(56) References Cited

U.S. PATENT DOCUMENTS

| | | | | |
|---|---|---|---|---|
| 2,614,518 | A | 10/1952 | Carter | |
| 4,498,412 | A * | 2/1985 | Liden | 114/264 |
| 4,829,928 | A * | 5/1989 | Bergman | 114/264 |
| 4,869,192 | A * | 9/1989 | Pawolski | 114/264 |
| 4,909,174 | A * | 3/1990 | Bowes | 114/264 |
| 4,987,846 | A * | 1/1991 | Yamashita et al. | 114/264 |
| 5,215,410 | A * | 6/1993 | Karal | 405/205 |
| 6,378,450 | B1 * | 4/2002 | Begnaud et al. | 114/264 |
| 6,457,908 | B1 | 10/2002 | Bergeron | |
| 6,565,286 | B2 * | 5/2003 | Carr et al. | 405/204 |
| 7,011,473 | B2 * | 3/2006 | Tangen et al. | 405/209 |
| 7,308,863 | B2 * | 12/2007 | de Baan | 114/264 |
| 7,527,006 | B2 | 5/2009 | Khachaturian | |
| 2001/0026733 | A1 * | 10/2001 | Ludwigson | 114/264 |
| 2001/0037757 | A1 * | 11/2001 | Bringedal et al. | 114/264 |
| 2002/0064092 | A1 | 5/2002 | Nishimura | |
| 2005/0152748 | A1 | 7/2005 | Tangen et al. | |
| 2005/0160959 | A1 | 7/2005 | Roodenburg et al. | |
| 2009/0129867 | A1 | 5/2009 | Millheim | |
| 2009/0194012 | A1 | 8/2009 | de Mattos | |
| 2009/0232605 | A1 | 9/2009 | Breivik | |

FOREIGN PATENT DOCUMENTS

| | | | |
|---|---|---|---|
| BR | 200306058 | A | 8/2005 |

* cited by examiner

*Primary Examiner*—Lars A Olson
(74) *Attorney, Agent, or Firm*—TraskBritt

(57) ABSTRACT

The present invention refers to a floating auxiliary structure, similar to a floating rigid portal, of simple construction and low cost, designed to facilitate moving of equipment of large sizes and mass in sea operations. With the aid of the auxiliary floating structure of the present invention, equipment of large size and mass, for exporting oil production, for example, may be transported until site and lowered into sea with the use of two conventional tug boats.

The invention also includes the procedure for removal of equipment from main tug boat and its descent until the sea.

7 Claims, 5 Drawing Sheets

AUXILIARY FLOATING STRUCTURE AND PROCEDURE FOR DESCENT OF EQUIPMENT INTO THE SEA

CROSS-REFERENCE TO RELATED APPLICATION

This application claims the benefit of the filing date of Brazilian Patent Application Serial No. PI 0800075-1 filed Feb. 1, 2008.

FIELD OF THE INVENTION

The present invention refers to an auxiliary floating structure, similar to a floating arcade of simple and low cost construction, designed to facilitate moving equipment of large sizes and mass in sea operations. With the help of the auxiliary floating structure of the present invention, equipment of large sizes and mass for exports of oil production, for example, may be transported until the site and lowered into the sea with the use of two conventional tug boats, eliminating contracting special vessels, normally required to accomplish such operations.

The invention also includes the procedure to remove such equipment from the tug deck and lower same safely into the sea.

BACKGROUND OF THE INVENTION

Deep water oil exploration requires the utilization of equipment of large sizes and mass. Usually, lowering equipment of this size, such as manifolds, from the deck of a vessel into the sea and subsequently see that it arrives safely at the bottom of the sea in submarine oil extracting fields, especially deep water and ultra deep water producer fields, requires utilization of special vessels, provided with adequate devices, such as heavy duty cranes and other facilities. Such vessels, in addition to implying in quite high lease cost, are not always available for hiring at the precise occasion when they are required, which may imply in difficulties for the continuation of oil exploration operations.

Consequently, one of the concerns of companies exploring oil in submarine fields, especially deep water fields, consists in searching for solutions eliminating or reducing, as much as possible, the need for utilizing such special high cost vessels.

RELATED ART

In submarine oil field exploration, one of the activities that most requires the use of special vessels involves transportation and descent to the bottom of the sea of equipment of large size and mass, not only due to sizes of the equipment involved, but also as a result of environmental and operational safety conditions. This activity encompasses four phases:

(a) embarkation of equipment aboard vessel;

(b) transportation until site;

(c) removal of equipment from vessel and positioning to descent to bottom of sea;

(d) descent of equipment to bottom of sea.

The first phase offers no problems, since equipment is available in harbor or yard facilities where it was manufactured. These sites normally have cranes and other facilities to place the equipment aboard the vessel which will take them to the oil exploration site.

The second phase also offers no larger difficulties, and only a vessel is required with adequate capability and space aboard to transport the equipment.

The third phase is a larger issue. Moving equipment of large size and mass in sea and position it to be lowered to the bottom, normally requires a vessel equipped with special cranes and/or other facilities and vessels with such resources not only have a high cost of lease, but are also rare on the market. As a result of this third phase, alternatively, one may use a common vessel to transport equipment until site and then use a special vessel to accomplish phase three, or also use the special vessel to accomplish the second and third phases.

When deep water oil fields are involved, phase four also represents an issue, since resonance phenomena may occur with the movement of vessel, caused by ocean waves, which may result in serious consequences, such as rupture of cables during descent of equipment.

The solution proposed by the present invention has as its object to solve the problems of phase three as shown above, in a simple fashion and at low cost.

SUMMARY OF THE INVENTION

The present invention offers an alternate solution to remove large sized equipment from a vessel and its positioning for descent to the bottom of the sea without a requirement of using special vessels. For this purpose, an auxiliary floating structure is being used, similar to a floating arcade, of simple and low cost construction, and two conventional tug boats. The auxiliary floating structure has adequate configuration and sizing to permit that the tug boat, transporting the equipment, may position itself inside and over it.

In general lines, the procedure used by the invention may be described as follows:

A first tug boat transports the equipment from harbor of embarkation until site of installation and a second tug boat (used as an auxiliary means) transports and positions the floating auxiliary structure. The auxiliary floating structure is being maneuvered by the second tug boat, while the first tug boat places equipment under the structure. Subsequently, the auxiliary floating structure raises the equipment, using ballast control and/or load traction equipment, releasing the first tug boat, which leaves the area. Suspended by the auxiliary floating structure, equipment is being lowered into the sea.

Several alternatives may be used for descent of equipment into the sea. Preferably, however, equipment should be tied to a cable or ropes, activated by the first tug boat. Thus, after the first tug boat leaves the area, the auxiliary floating structure descends equipment to a level below the bottom section of the first tug boat and, subsequently, by means of sustaining cables maneuvers, transfers equipment cargo to the cables of the first tug boat.

DETAILED DESCRIPTION OF THE INVENTION

Figure 1:
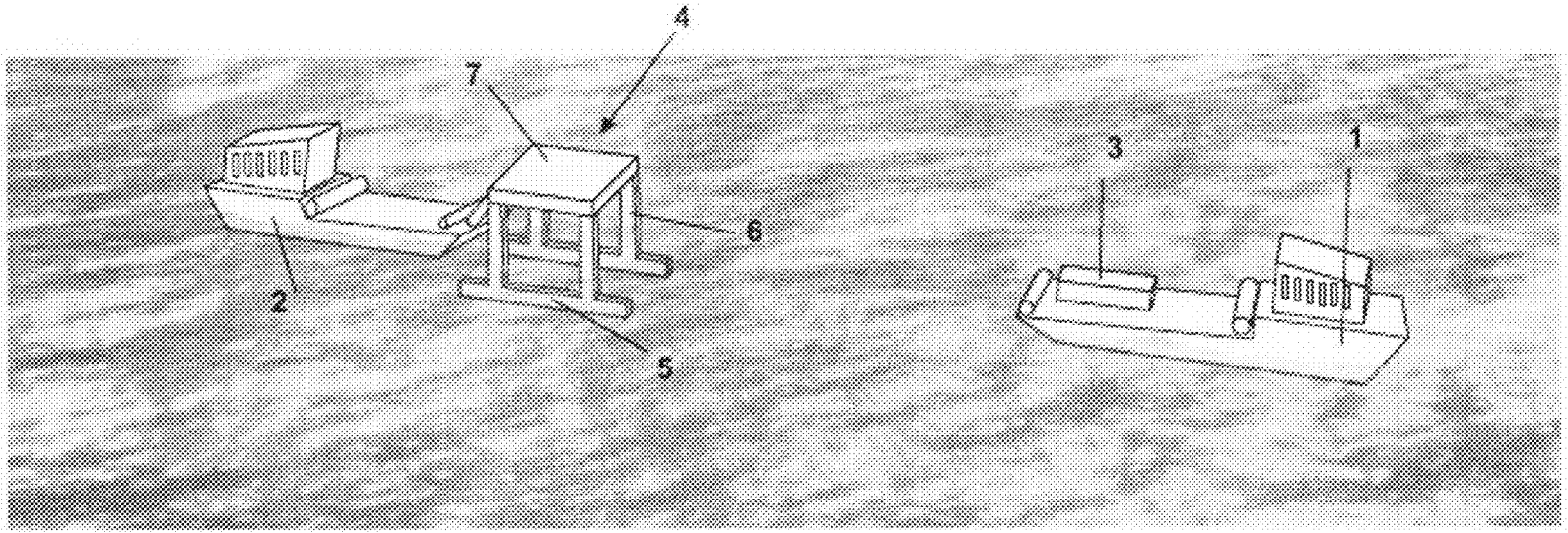
FIG. 1 shows in a perspective view of both tug boats taking position to hoist equipment through the auxiliary floating structure.
Figure 2A:
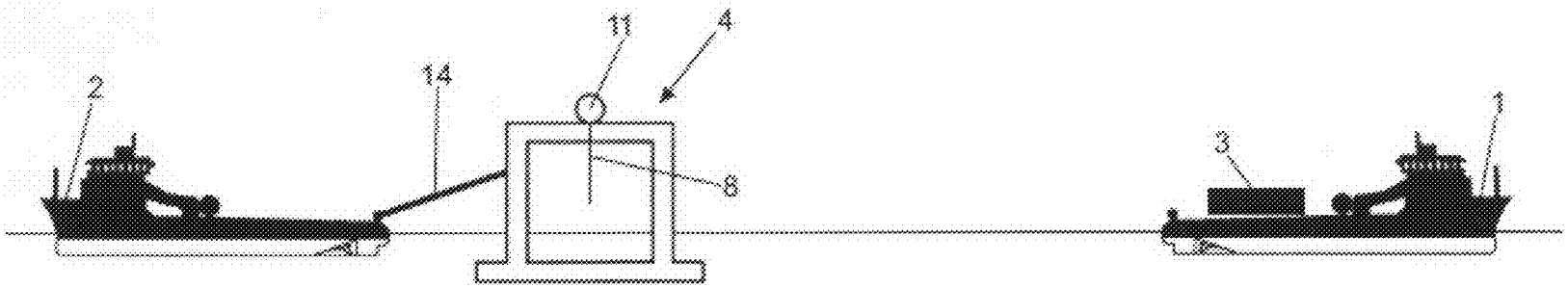
FIGS. 2-A to 2-K feature the sequence of procedural steps to remove equipment from deck of the first tug boat and its descent into the sea.
Figure 2B:
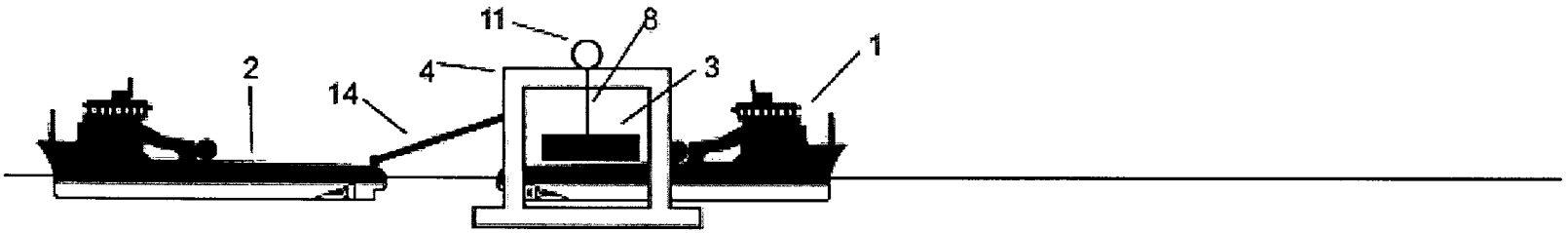
Figure 2C:
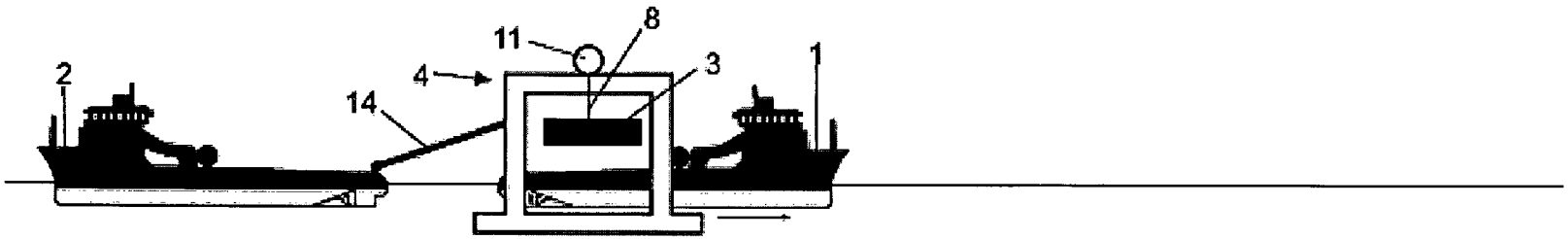
Figure 2D:
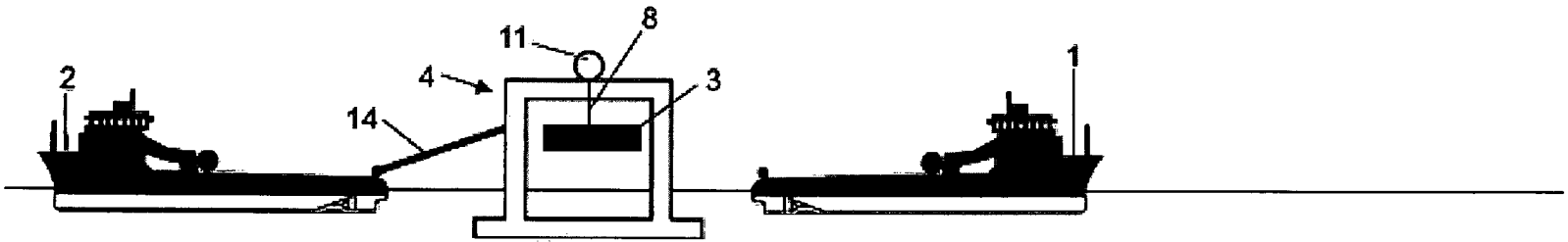
Figure 2E:
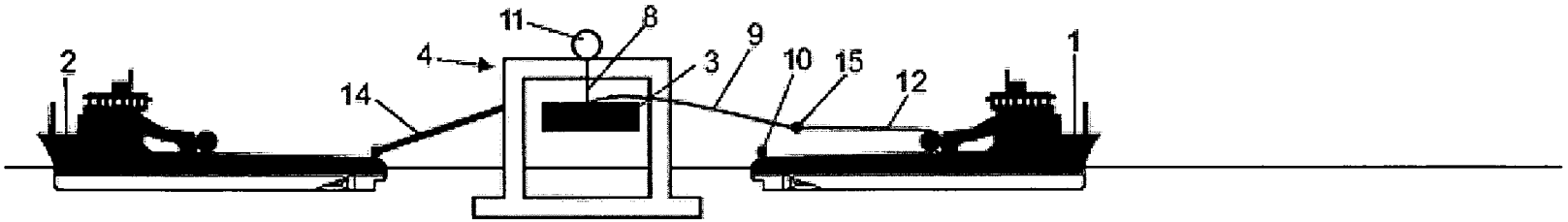
Figure 2F:
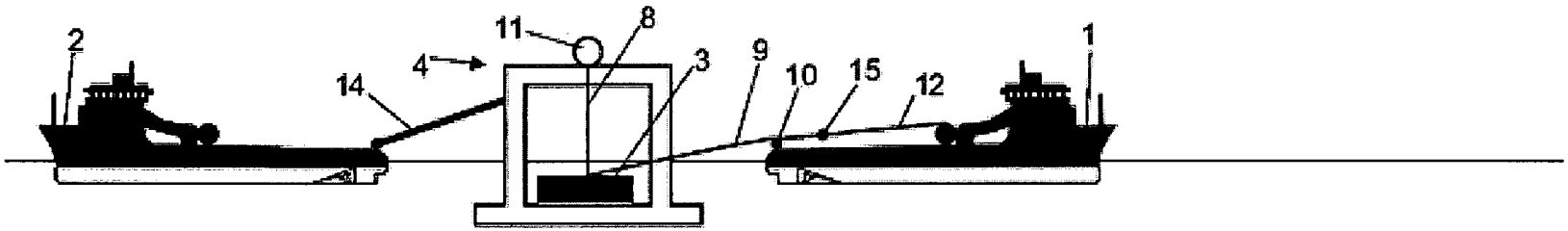
Figure 2G:
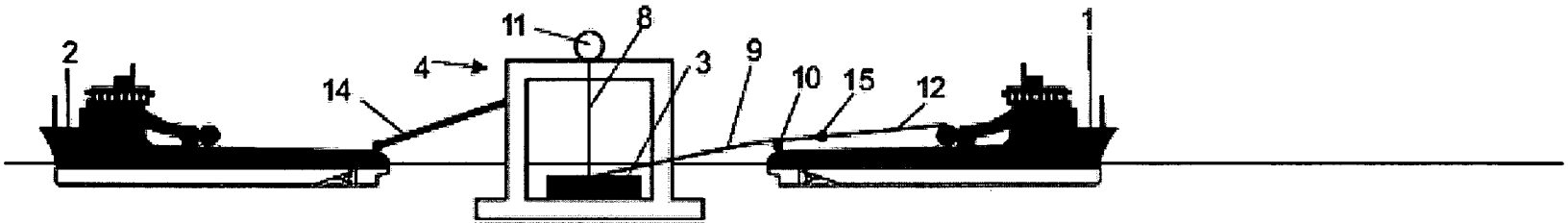
Figure 2H:
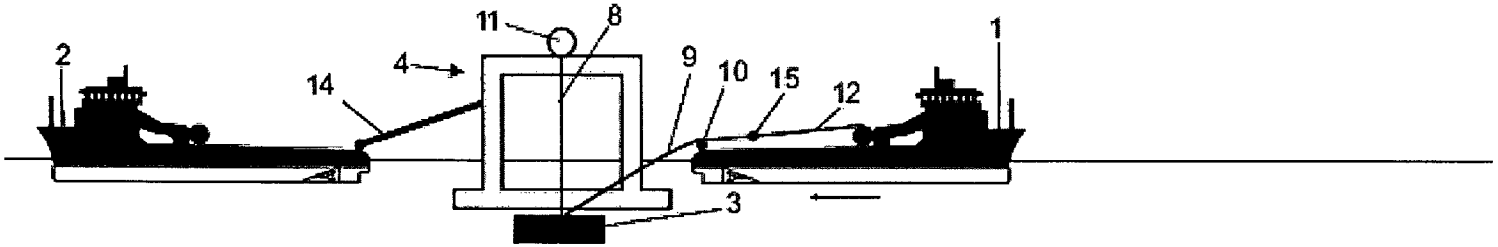
Figure 2I:
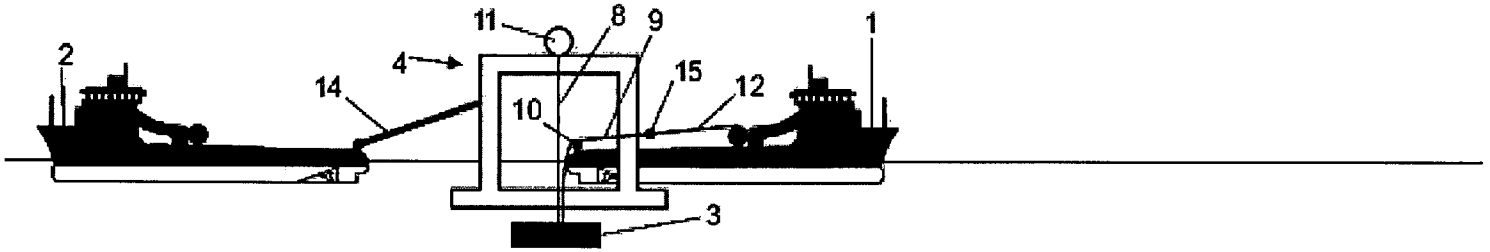
Figure 2J:
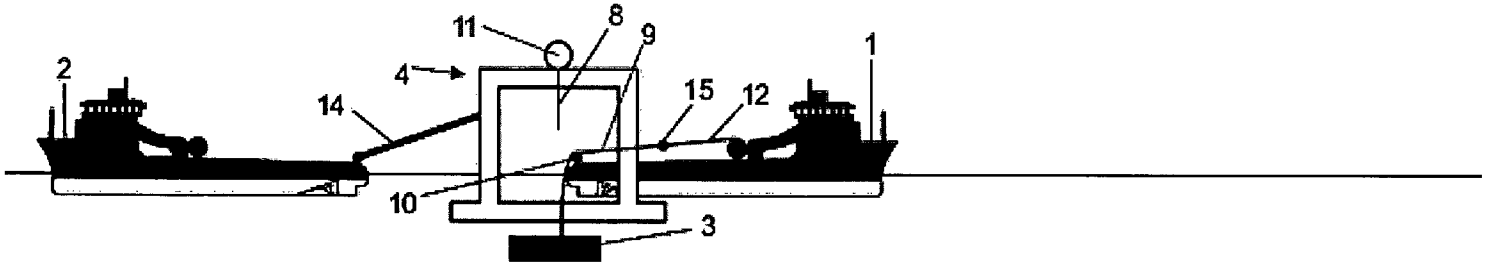
Figure 2K:
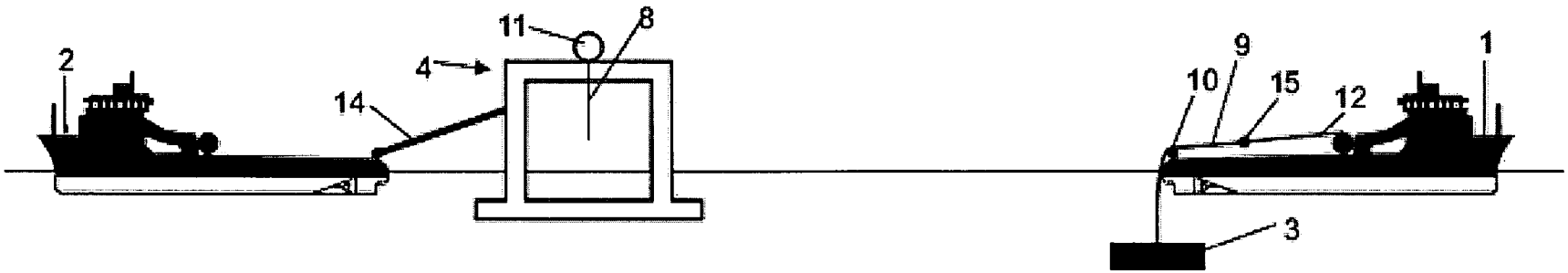

In order to facilitate comprehension of the invention, its detailed description will be made, based on the figures accompanying this report, of which they are a whole part.

Tug boats (1 e 2) used in the present invention, are conventional tugs with dynamic positioning (type A. H. T. S.—Anchor Handling Tug Supply) and must contain the conventional gear for this type of vessel. Tug boat hauling equipment (3) of large size and mass will be subsequently called main tug boat (1) and tug boat that hauls and maneuvers the auxiliary floating structure (4) will subsequently be called auxiliary tug boat (2).

The auxiliary floating structure (4) is composed by a deck (7), supporting columns or pontoons (6) and floaters or submarines (5). Deck (7) is provided with means to hoist equipment (3) and is sustained by the supporting columns (6). The submarines (5) are connected to the columns (6) in their lower section and contain adequate tanks to insure floatability of set by means of ballast control.

The auxiliary floating structure (4) may feature any configuration and its dimensions must be sufficient so that vessel hauling equipment (3) may enter between its supporting columns (6) and position itself under the deck (7). While cables and respective winding/unwinding devices, compressors, etc., may be set up on the auxiliary floating structure (4), it is preferable that it features only the devices which will attach the equipment (3) to its deck (7), such as a crane drum (11) for passing hoisting cable (8) from the equipment (3) and use compressors and other gear required for operation, which are installed in the auxiliary tug boat (2), as this simplifies and lowers cost figures for its construction. In this case, the structure will only feature the respective connecting elements. The hoisting cable (8) to be used may either be part of the auxiliary tug boat (2) gear, as well as of the auxiliary floating structure (4).

Alternately, the auxiliary floating structure (4) may have all devices it requires, including its own propulsion and, in this case, may accomplish displacement and positioning by its own means, which will permit to release usage of the auxiliary tug (2).

Another alternative would consist in transforming a vessel available, that could be revamped in a fashion so as to permit positioning of tug boat (1) under same.

Initially, the auxiliary floating structure (4) is conducted attached to auxiliary tug (2) in an adequate fashion to provide to both the tug 2+floating structure the required maneuvering capability for correct positioning. Connections are being of compressors from auxiliary tug (2) to floatability tanks of auxiliary floating structure (4), as well as connections of other devices (energy, range finders, etc.) of the auxiliary floating structure (4), which will thus be prepared to hoist equipment (3). Simultaneously, the main tug boat (1) approaches the location, bringing aboard the equipment (3), which is desired to be lowered.

Removal of equipment (3) from main tug boat (1) and its positioning for descent into the sea, is shown in FIGS. 2-A thru 2-K.

As can be seen in FIG. 2-A, auxiliary tug boat (2) places the auxiliary floating structure (4) at the location where equipment (3) will be lowered into the sea and main tug boat (1) is approaching with same. FIG. 1 shows a perspective view of this situation.

The main tug boat (1) enters in reverse running status under deck (7) of auxiliary floating structure (4) and positions equipment (3), which is being attached to cable (8) to be hoisted (FIG. 2-B).

By means of the auxiliary tug boat (2) compressors, the loading tanks of the auxiliary floating structure (4) are being alleviated, permitting structure to rise, thus hoisting equipment (3) and releasing main tug boat (1), as shown in FIG. 2-C. If required, cable (8) may be wound. To assist in hoisting operation, once released main tug boat (1) abandons auxiliary floating structure (4) (FIG. 2-D).

At this point, equipment (3) could be lowered into the sea, using the auxiliary tug boat (2) and auxiliary floating structure (4), eventually with the aid of some other device or vessel. Preferably, however, a sling (9) must be attached to equipment (3) and to cable (12), activated by main tug boat (1). The precise moment of attaching sling (9) to cable (12) and to equipment (3) must be defined in function of facilities available for each case. Thus, when main tug boat (1) moves away, it needs to unwind cable (12) (FIG. 2-E).

After main tug boat (1) withdrawing from the auxiliary floating structure (4), the latter unwinds cable (8), lowering equipment (3) until a point where it remains below the lower level of the main tug boat (1) hull (FIGS. 2-E and FIG. 2-H). At the same time, main tug boat (1) maneuvers cable (12), accomplishing descent of equipment (3).

After equipment (3) reaches an adequate and safe level below hull of main tug boat (1), the latter again penetrates the auxiliary floating structure (4), winding up cable (12), until sling (9) occupies a position as vertical as possible, supported on stern roller (10) (FIG. 2-*i*). This maneuver intends to transfer cargo until then sustained by the auxiliary floating structure (4) into main tug boat (1). At this point, auxiliary floating structure (4), disconnects cable (8) of equipment (3) and retreats same (FIG. 2-J). Auxiliary tug boat (2) moves away with auxiliary floating structure (4) (FIG. 2-K). Alternately, approach of main tug boat (1) for transfer of cargo, may be called off and transfer may take place at a distance from the auxiliary floating structure (4) which operators regard safe.

In the event equipment (3) is designed for a shallow waters oil field, main tug boat (1) may undertake lowering equipment directly to sea bottom. If descent is to be made in a deep water field, the use of an appropriate technique will be needed to avoid resonance phenomena during descent.

While the "AUXILIARY FLOATING STRUCTURE AND PROCEDURE FOR DESCENT OF EQUIPMENT INTO THE SEA" as described above with regard to the attached drawings, is being presented as a preferred form of configuration of the invention, it will be understood that several changes may be introduced without abandoning concepts exposed herein, and some elements may be replaced by others with the same technical function, especially materials and equipment utilized, their sizes, forms and proportions.

What is claimed is:

1. A procedure for descent of equipment into the sea, characterized in that said procedure is composed of the following steps:

(a) providing an auxiliary floating structure comprising a deck, supporting columns and pontoons, wherein said deck is provided with means to hoist equipment and is sustained by said supporting columns, and said pontoons being attached to said columns at a lower portion thereof, said pontoons containing tanks to ensure floatability by means of a ballast control, and dimensions of said auxiliary floating structure being sufficient so that a vessel transporting equipment may pass between said supporting columns and take up a position under said deck:

(b) conducting said auxiliary floating structure, attached to an auxiliary tug boat, by means of beams, provided with articulation joints, until reaching a location where equipment will be lowered into the sea, said auxiliary tug boat having compressors associated therewith;

(c) attaching said compressors of said auxiliary tug boat to said tanks of the auxiliary floating structure, as well as other requirements of said auxiliary floating structure, the auxiliary floating structure remaining prepared to hoist equipment;

(d) at the same time, as a main tug boat approaches said location, bringing on board said auxiliary floating structure equipment desired to be lowered;

(e) positioning said auxiliary floating structure by means of said auxiliary tug boat in said location where equipment will be lowered into the sea, while said main tug boat approaches jointly with same and penetrates in reverse gear status under said deck of said auxiliary floating structure;

(f) positioning said equipment, tied to cable to be hoisted, by means of said main tug boat;

(g) activating said auxiliary tug boat compressors to alleviate said tanks of said auxiliary floating structure, thereby permitting said auxiliary floating structure to raise, hoisting said equipment and releasing said main tug boat;

(h) if required, unwinding cable to assist in hoisting operation;

(i) moving said main tug boat away from said auxiliary floating structure after a hoisting of said equipment;

(j) attaching a sling to said equipment and to said cable activated by said main tug boat before the main tug boat moves away from said auxiliary floating structure, however, the exact occasion of attaching said sling to said cable and to said equipment is being defined as a result of facilities available for each case;

(k) after main tug boat has moved away from said auxiliary floating structure, the auxiliary floating structure unwinds cable, lowering said equipment until a point, where said equipment remains below a lower level of the main tug boat hull and, at the same time, said main tug boat maneuvers cable, accompanying a descent of said equipment;

(l) after said equipment attains a level below said main tug boat, the latter again penetrates into auxiliary floating structure, winding up cable, until said sling is as close as possible to being vertically positioned and supported on a stern roller;

(m) transferring said equipment, so far as sustained by said auxiliary floating structure to said main tug boat, disconnecting said cable from said equipment and retracting said cable; and (n) moving said auxiliary tug boat away with auxiliary floating structure.

2. The procedure for descent of equipment into the sea according to claim 1, characterized in that, alternately, after step (i) of said equipment being lowered to the sea bottom, using said auxiliary tug boat and said auxiliary floating structure, with the aid of some other device or vessel, without accomplishing the other steps.

3. The procedure for descent of equipment into the sea according to claim 1, characterized wherein said approach of said main tug boat for transferring of cargo (step 1) being waived and said transferring taking place at a distance from said auxiliary floating structure considered safe by operators.

4. A procedure for descent of equipment into the sea by using the floating auxiliary structure described in claim 1, characterized by the following steps:

(a) auxiliary floating structure is being conducted attached to an auxiliary tug boat by means of beams, provided with articulation joints, until location where said equipment will be lowered into sea;

(b) attaching the auxiliary tug boat to a pontoon of the auxiliary floating structure, which is provided with devices required for maneuvers in order to be prepared to hoist said equipment;

(c) at the same time, a main tug boat approaches to the location, bringing on board the equipment desired to be lowered;

(d) auxiliary tug boat positions auxiliary floating structure in a spot where equipment will be lowered into sea and the main tug boat approaches jointly with same and penetrates in reverse gear status under deck of auxiliary floating structure;

(e) main tug boat positions said equipment, which is tied to cable, to be hoisted;

(f) activate auxiliary tug boat compressors to alleviate floating tanks of auxiliary floating structure, permitting it to raise, hoisting equipment and releasing the main tug boat;

(g) if required, unwind the cable to assist in hoisting maneuver;

(h) main tug boat moves away from auxiliary floating structure after hoisting of equipment;

(i) a sling is attached to the equipment and to a cable activated by the main tug boat before the main tug boat moves away from the auxiliary floating structure, however, the exact occasion of attaching sling to cable and to equipment is being defined as a result of facilities available for each case;

(j) after main tug boat moves away from auxiliary floating structure, the main tug boat unwinds the cable, permitting the equipment to descent until a point, where it remains below the lower level of the main tug boat hull and, at the same time, the main tug boat maneuvers cable, accompanying said descent of equipment;

(k) after equipment attains a level below main tug boat, the main tug boat again penetrates into the auxiliary floating structure, winding up the cable, until sling is as close as possible vertically positioned, supported on a stern roller;

(l) transfer of the equipment, so far sustained by the auxiliary floating structure to the main tug boat, disconnecting cable from equipment and gathering said cable; and (m) the auxiliary tug boat moves away with the auxiliary floating structure.

5. The procedure for descent of equipment into the sea according to claim 4, characterized in that, alternately, after step h of the procedure, said equipment is lowered to sea bottom, by using auxiliary tug boat and auxiliary floating structure, with the aid of some other device or vessel, without accomplishing the other steps.

6. The procedure for descent of equipment into the sea according to claim 4, characterized in that alternately, the approach of the main tug boat for transfer of cargo (step K) being waived and a transfer takes place at a distance from auxiliary floating structure considered safe by operators.

7. The procedure for descent of equipment into the sea according to claim 1, wherein said means to hoist equipment is positioned centrally on said deck to access equipment positioned on a vessel transporting said equipment, between said supporting columns and below said deck.

* * * * *